US006179934B1

(12) United States Patent
Kawakami et al.

(10) Patent No.: US 6,179,934 B1
(45) Date of Patent: Jan. 30, 2001

(54) AQUEOUS PHOSPHATING COMPOSITION AND PROCESS FOR METAL SURFACES

(75) Inventors: Masahiko Kawakami; Naoyuki Kobayashi; Kazuyuki Oyama, all of Nagoya (JP)

(73) Assignee: Henkel Corporation, Gulph Mills, PA (US)

( * ) Notice: Under 35 U.S.C. 154(b), the term of this patent shall be extended for 0 days.

(21) Appl. No.: 09/355,050

(22) PCT Filed: Jan. 22, 1998

(86) PCT No.: PCT/US98/00903

§ 371 Date: Jul. 22, 1999

§ 102(e) Date: Jul. 22, 1999

(87) PCT Pub. No.: WO98/32894

PCT Pub. Date: Jul. 30, 1998

(30) Foreign Application Priority Data

Jan. 24, 1997 (JP) ..... 9-011357

(51) Int. Cl.[7] ..... C23C 22/07
(52) U.S. Cl. ..... 148/260; 148/262
(58) Field of Search ..... 148/250, 260, 148/262

(56) References Cited

U.S. PATENT DOCUMENTS

| | | | | |
|---|---|---|---|---|
| 2,298,280 | * | 10/1942 | Clifford et al. | 148/6.5 |
| 2,743,204 | * | 4/1956 | Russell | 148/6.15 |
| 4,865,653 | * | 9/1989 | Kramer | 148/6.15 |
| 5,143,562 | | 9/1992 | Boulos | 148/247 |
| 5,236,565 | | 8/1993 | Muller et al. | 148/262 |
| 5,261,973 | | 11/1993 | Sienkowski et al. | 148/262 |
| 5,597,465 | | 1/1997 | Pedrazzini | 204/486 |

FOREIGN PATENT DOCUMENTS

| | | | |
|---|---|---|---|
| 4241134 | | 6/1994 | (DE) . |
| 4433946 | | 3/1996 | (DE) . |
| 19538778 | | 4/1997 | (DE) . |
| 19540085 | | 4/1997 | (DE) . |
| 19639597 | | 4/1998 | (DE) . |
| 0287133 | | 10/1988 | (EP) . |
| 9303198 | | 2/1993 | (EP) . |
| 9717480 | | 5/1997 | (EP) . |
| 9813534 | | 2/1998 | (EP) . |
| 1172741 | | 2/1959 | (FR) . |
| 2022052 | | 7/1970 | (FR) . |
| 2569203 | | 2/1986 | (FR) . |
| 1532758 | | 11/1978 | (GB) . |
| 01 123080 | * | 5/1989 | (JP) . |
| 5-195245 | * | 8/1993 | (JP) . |
| 5-195246 | * | 8/1993 | (JP) . |

* cited by examiner

*Primary Examiner*—John Sheehan
*Assistant Examiner*—Andrew L. Oltmans
(74) *Attorney, Agent, or Firm*—Wayne C. Jaeschke; Stephen D. Harper; Norvell E. Wisdom, Jr.

(57) ABSTRACT

An aqueous zinc phosphate conversion coating that contains 5 to 50 g/L of phosphate ions, 0.2 to 10 g/L of zinc ions, and 0.5 to 4.0 g/L as hydroxylamine of a hydroxylamine source, and also: (1) contains 0.01 to 5.0 g/L polycarboxylic acid or salt thereof and/or starch phosphate; or (2) has a zinc ions/phosphate ions weight ratio below 0.27 and a zinc ions concentration of at least 2.0 g/L forms high quality zinc phosphating coatings on metal surfaces even if the surfaces have not been previously conditioned by contact with a dispersion of colloidal titanium.

22 Claims, No Drawings

AQUEOUS PHOSPHATING COMPOSITION AND PROCESS FOR METAL SURFACES

FIELD OF THE INVENTION

This invention relates to a treatment composition, more particularly a liquid solution in water, that forms a zinc phosphate-type conversion coating on metal surfaces and to a method for treating metal surfaces with such a treatment composition. The invention is particularly effective when applied to iron and steel, but in addition it can also be applied to a variety of surfaces that are constituted of zinc or an alloy thereof and/or aluminum or an alloy thereof, such alloys containing at least 55 atomic percent of zinc or of aluminum.

DESCRIPTION OF RELATED ART

Zinc phosphate treatments are carried out in order to impart corrosion resistance to metals such as iron and steel, as an undercoating for painting operations, and to provide lubrication in forging and wire drawing operations. This treatment is carried out by bringing the workpiece into contact with the treatment composition, often called a "bath" hereinafter, even though not necessarily contacted by immersion of the metal substrates in it, for a sufficient period of time at an appropriate temperature. Spraying and/or dipping are typically employed to effect this contact. The overall process generally proceeds through the following steps.

(1) Cleaning (2) Surface conditioning (3) Phosphate conversion treatment (4) Post-treatment A water rinse is typically used between each of these steps and the next successive one of these steps, except between steps (2) and (3), in order to avoid dragging material from an upstream step into a downstream step.

Cleaning step (1) is carried out in order to remove grease and other contaminants adhering to the workpiece and thereby provide for the smooth execution of the downstream steps. An alkaline cleaner is typically used in this cleaning step.

In the surface conditioning step (2), the workpiece is typically brought into contact with a treatment bath that contains colloidal titanium. This treatment results in a substantial acceleration of the film-forming reactions during the phosphate conversion treatment and in this manner makes possible the formation of a uniform, fine, and dense conversion coating in a short period of time. The use of phosphate coatings as paint-base coatings on automotive components requires high-quality phosphate coatings that must exhibit paint adherence and corrosion resistance, and the surface conditioning step has been considered essential for the production of coatings of this type.

Phosphate conversion treatment step (3) is run using a variety of treatment bath compositions and treatment conditions whose particular selection will depend on the specific objective. As an example, in the case of paint-base coating treatments for automotive components, the ingredients present in a zinc phosphate-type treatment bath will be phosphate ions, zinc ions, and other metal ions (e.g., nickel, manganese), and each of these components will provide specific properties to the final film. Other components typically present in baths of this type are nitrate, nitrite, chlorate, fluoroborate, and fluorosilicate. A lowering of the treatment temperature has been pursued over the last few years, and at present these treatments are run at temperatures of 40° C. to 50° C. for treatment times of about 1.5 to 3 minutes. The treatment is often carried out by dipping.

Post-treatment step (4) is carried out, for example, in order to improve the corrosion resistance and paint adherence. A treatment bath, either containing hexavalent chromium or chromium-free, is used as the post-treatment agent. This step may be omitted depending on the particular objective or application.

The high-quality zinc phosphate-type conversion films used as paint-base coatings on iron and steel can be evaluated through (1) the appearance of the conversion coating, (2) the coating weight, and (3) the P/(P+H) ratio as defined below.

The following characteristics are essential, or if so stated, preferred, for rating as "good" the appearance of a conversion coating: The conversion coating must be free of defects such as rust, blue color, and thin or incomplete coverage, and in addition is preferably a columnar and/or nodular crystalline coating whose crystals are preferably microcrystalline, with sizes from about 1 to 5 micrometers (hereinafter usually abbreviated as "$\mu$m").

The mass of the coating formed divided by the area of the surface being coated, a value also denoted as "coating weight" hereinafter, as a general rule is preferably from about 1 to 3 grams per square meter (hereinafter usually abbreviated as "g/m$^2$").

The P/(P+H) ratio is calculated from the immediately following equation:

$$P/(P+H)\ \text{ratio} = lp/(lp+lh)$$

where lh represents the X-ray diffraction intensity from the (020) surface of hopeite (zinc phosphate) and lp represents the X-ray diffraction intensity from the (100) surface of phosphophyllite (zinc iron phosphate) or one of its analogs in which manganese, nickel, cobalt, calcium, magnesium, copper and/or the like cations that were dissolved in the phosphating solution can replace some or all of the iron cations in phosphophyllite itself. The P/(P+H) ratio is widely recognized as a characterizing value for the zinc phosphate-type films used as paint-base coatings on iron and steel. P/(P+H) values of 0.8 to 1 are generally considered to provide good conversion coatings for paint-base coatings.

A coating solution taught in Japanese Patent Application Laid Open (Kokai or Unexamined) Number Hei 1-123080 (123,080/1989) uses hydroxylamine sulfate (HAS) as an accelerator. The intent in this case is through the use of this accelerator to change the film morphology from platelet structures to columnar and/or nodular structures over a broad range of zinc concentrations. While Ni and Mn are mentioned as general supplementary ions, neither the Detailed Description nor the Examples provide an explanation of how their quantity of addition should be determined. This reference also describes a relatively large number of other patents in which hydroxylamine sulfate is added to zinc phosphate solutions and in addition describes patents in which oxidizing agent is present, including U.S. Pat. Nos. 2,743,204 and 2,298,280.

Japanese Patent Application Laid Open Number Hei 1-123080 also teaches treatment of the metal surface with a colloidal titanium-containing surface conditioner prior to conversion treatment.

The hydroxylamine source is taught to be added to the conversion bath taught in Japanese Patent Application Laid Open Number Hei 1-123080 in order to broaden the permissible range of zinc concentrations in the bath at which the desired conversion coatings can be obtained. In this reference the zinc concentration range is expressed by the zinc/phosphate ions ratio. The zinc/phosphate ions weight ratio is no more than 0.27 while the concentration of the zinc itself is from 0.02 to 0.2 weight %, which is equivalent to about 0.2 to 2 grams per liter of total composition (hereinafter usually abbreviated as "g/L").

A phosphate conversion treatment bath taught in Japanese Patent Application Laid Open (Kokai or Unexamined) Number Hei 5-195245 (195,245/1993)contains hydroxylamine (HAS), nickel ions, and manganese ions. This reference also teaches surface conditioning with a colloidal titanium-containing bath prior to conversion treatment.

Japanese Patent Application Laid Open Number Hei 5-195245 teaches nickel ions and manganese ions as essential components in its treatment bath and also stipulates about 1/25 to 1/10 as a more desirable range for the zinc ions/phosphate ions weight ratio for the treatment bath of Japanese Patent Application Laid Open (Kokai or Unexamined) Number Hei 1-123080. The nickel ions content in this case is specified as from 0.02 to 0.15 weight % and the manganese ions content is specified as from 0.02 to 0.15 weight %. Also specified is a zinc ions/(manganese ions+nickel ions) weight ratio of about 1/1.5 to 1/0.5.

The phosphate conversion treatment bath taught in Japanese Patent Application Laid Open (Kokai or Unexamined) Number Hei 5-195246 (195,246/1993) uses a combination of simple and complex fluoride, a chelating agent for iron, phosphate ions, a hydroxylamine source, and an oxidizing agent selected from water-soluble aromatic organic nitro compounds, molybdic acid salts, and tungstic acid. This bath can efficiently form a highly corrosion-resistant phosphate conversion coating on a variety of metal surfaces without requiring the use of the divalent and higher valent metal ions used in the prior art.

This treatment bath may also contain a colloidal titanium compound, in which case conversion treatment and surface conditioning can be carried out in a single step.

The laid-open patent applications cited above make no statements regarding omission of the surface conditioning step, and in fact state that inclusion of a surface conditioning step is desirable. Moreover, as a result of our own investigations we have found that the conversion treatment baths of Japanese Patent Application Laid Open (Kokai or Unexamined) Numbers Hei 1-123080 and Hei 5-195246, while able to produce conversion coatings even in the absence of a surface conditioning step, are inadequate in this case to the task of producing the high-quality conversion coatings applicable as paint-base coatings.

PROBLEMS TO BE SOLVED BY THE INVENTION

The present invention provides a treatment bath that can form a high-quality phosphate coating on metal surfaces with or without the execution of a surface conditioning step. The present invention also provides a method for treating metal surfaces.

Surface conditioning with a colloidal titanium-containing treatment bath has until now been essential, for example, in the case of phosphate treatments tasked with the formation of high-quality conversion coatings as typified by the paint-base coatings for automotive steel sheet. The introduction of a conversion treatment bath that can form high-quality conversion coatings even in the absence of a surface conditioning step will permit the pursuit of conversion treatment facilities that require less space and will offer the advantage of rendering unnecessary the work inputs associated with management of the surface conditioning bath.

In addition, the present invention specifically provides a method that even in the absence of a surface conditioning step can form high-quality zinc phosphate coatings, most importantly on articles that must exhibit corrosion resistance and for which adhesion must be generated between a paint film, rubber, or plastic and a surface of iron or steel. The zinc phosphate coating afforded by the present invention can not only be used as a paint-base coating, but can also be used as an adhesion-base coating, for example, in the adhesion of resin films or rubbers to an iron or steel surface.

SUMMARY OF THE INVENTION

It has been discovered that high-quality zinc phosphate conversion coatings can be produced on a stable basis, without having to resort to the use of a surface conditioning step through the use of hydroxylamine in combination with polycarboxylic acid(s) or salt(s) thereof and/or starch phosphate or by maintaining both a suitable concentration for the zinc ions and an upper limit on the ratio of zinc ions to phosphate ions present in the conversion treatment bath.

DETAILED DESCRIPTION OF THE INVENTION AND OF PREFERRED EMBODIMENTS

A preferable composition according to a first embodiment of the invention is an aqueous zinc phosphate solution that contains phosphate ions at from 5 to 50 g/L, zinc ions at from 0.2 to 10, or preferably from 2.0 to 10, g/L, a hydroxylamine source in a quantity that provides hydroxylamine at from 0.5 to 4.0 g/L, and 0.01 to 5.0 g/L of at least one selection from the group consisting of polycarboxylic acids, salts thereof, and starch phosphate.

The hydroxylamine source is believed to increase the conversion reactivity of the phosphate treatment solution. Thus, the hydroxylamine source is a component that makes possible omission of the surface conditioning step. The chemical nature of the hydroxylamine source added to the coating treatment solution according to the present invention is not critical and may be, for example, a salt or complex salt of hydroxylamine. Specific preferred examples are the phosphate, nitrate, and sulfate salts of hydroxylamine and mixtures thereof.

In the present invention the hydroxylamine quantities are reported in terms of the stoichiometric equivalent of hydroxylamine as calculated from the addition of the hydroxylamine source. For the example of hydroxylamine sulfate as the hydroxylamine source, the addition of 10 g/L of hydroxylamine sulfate provides 4.0 g/L hydroxylamine. The hydroxylamine source is preferably added so as to give from 0.5 to 4.0 grams of hydroxylamine per liter. Concentrations below this range are without adequate effect and thus result in poor coating in the absence of a surface conditioning treatment. Values in excess of 4.0 g/L have a pronounced tendency to produce such defects as blue color.

Addition of the polycarboxylic acid and/or salt thereof or starch phosphate to the zinc phosphate treatment solution supports and facilitates the production of high-quality zinc phosphate conversion coatings by controlling the weight of the conversion coating and inhibiting coarsening of the crystals in the conversion coating. However, an addition in excess of 5 g/L has the contrary effect of inhibiting the conversion reactivity. Polycarboxylic acid refers to compounds that contain at least two carboxyl moieties in each molecule and in the context of the present invention also encompasses hydroxycarboxylic acids that contain one or more hydroxyl moieties in addition to at least two carboxyl moieties. Typical examples of the subject polycarboxylic acids are citric acid, tartaric acid, succinic acid, ethylenediaminetetraacetic acid, and nitrilotriacetic acid, with the first three of these constituting a preferred group and citric acid most preferred. Their salts are exemplified by the sodium, potassium, ammonium, and iron ammonium salts.

A composition according to a second preferred embodiment of the invention is an aqueous zinc phosphate solution that contains phosphate ions at a concentration from 7.5 to 50 g/L, zinc ions at a concentration from 2 to 10 g/L, and a hydroxylamine source in a quantity that provides hydroxylamine at a concentration from 0.5 to 4.0 g/L and in which the zinc ions/phosphate ions weight ratio is not more than 0.27. The use of this treatment solution at temperatures of 40° C. to 50° C. for treatment times of at least 1 minute produces high-quality zinc phosphate coatings consisting mainly of nodular and/or columnar zinc iron phosphate crystals. Either dipping or spraying can be used as the treatment methodology.

At least 7.5 g/L of phosphate ions are required to avoid too high a zinc to phosphate ions ratio with even the minimum concentration of zinc suitable for this embodiment. While a conversion coating is produced at phosphate ions values in excess of 50 g/L, such levels are uneconomical due to the increased reagent consumption, for example, by drag out.

Suitable zinc ions concentrations for this second preferred embodiment are from 2 to 10 g/L. While a conversion coating can be obtained at zinc ions concentrations below 2 g/L even in the absence of a surface conditioning step, the coverage by such coatings has a pronounced tendency to be thin or incomplete. Zinc ions concentrations in excess of 10 g/L cause the weight of the resulting conversion film to be too large, making it unsatisfactory as a high quality paint-base coating.

The type of hydroxylamine source and its content range are the same as in the first preferred specific embodiment. The zinc ions/phosphate ions weight ratio should be at or below 0.27. Precipitation occurs in the conversion treatment bath at values in excess of 0.27; this not only impairs the stability of the treatment bath but also prevents the production of normal conversion coatings.

The aqueous zinc phosphate solutions of the first and second preferred embodiments may also contain ferrous ions. The presence of ferrous ions improves the conversion treatment activity. However, since ferrous ions are supplied by the etching of an iron or steel workpiece by the conversion treatment solution itself, ferrous ions are typically present to some degree even in the absence of any deliberate addition of them to the treatment bath.

At least one selection from the following may be added in order to obtain additional improvements in the conversion treatment activity and/or additional improvements in the quality of the conversion coating: nickel ions, manganese ions, nitrate ions, fluorine (as a chemical compound of fluorine), and complex fluoride ions.

The concentrations of the ferrous ions, nickel ions, manganese ions, nitrate ions, fluorine, and complex fluoride ions are preferably in the range from 0.01 to 5 g/L.

In a preferred method for replenishing the reagents, the treatment bath is supplied with a replenisher composition comprising an aqueous solution containing zinc ions, phosphate ions, and hydroxylamine source in which the total concentration of these species is at least 15 weight %.

The invention may be further appreciated by consideration of the non-limiting working examples and comparison examples shown below.

The next following tests were carried out in order to demonstrate the advantageous effects of the present invention in its first preferred embodiment as described above.

The test substrates were cold-rolled steel panels with a thickness of 0.8 millimeter, a unit hereinafter usually abbreviated in either singular or plural as "mm", and major dimensions of 70 mm×150 mm. Conversion treatment was carried out using the conversion treatment solutions reported in Table 1 and the properties of the resulting coatings were tested. Conversion-treated test panels were also painted as described below in order to test the painting performance.

Process steps (1) Degreasing.

Degreasing was carried out using FINECLEANER® L4460 alkaline degreaser from Nihon Parkerizing Co., Ltd. The conditions were as follows: 43° C., 120 seconds, spray.

TABLE 1

| Composition for: | Concentration in g/L in the Composition of: | | | | | | | |
|---|---|---|---|---|---|---|---|---|
| | $PO_4^{-3}$ Ions | Hydroxylamine | $Zn^{+2}$ Ions | $Ni^{+2}$ Ions | $Mn^{+2}$ Ions | $Fe^{+2}$ Ions | Fluorine | Other Additional Solute If Any |
| Example 1 | 15 | 2 | 2 | 0 | 0 | 0 | 0 | Ferric ammonium citrate 2.0 |
| Example 2 | 15 | 2 | 2 | 1 | 0 | 0.01 | 0.2 | Ferric ammonium citrate 2.0 |
| Example 3 | 20 | 4 | 5 | 1 | 0.5 | 0.01 | 0.2 | Ferric ammonium citrate 2.0 |
| Example 4 | 15 | 2 | 2 | 1 | 0 | 0.01 | 0.2 | Sodium tartrate 2.0 |
| Example 5 | 15 | 2 | 2 | 1 | 0 | 0.01 | 0.2 | Sodium succinate 2.0 |
| Example 6 | 15 | 2 | 2 | 1 | 0 | 0.01 | 0.2 | Starch phosphate 1.0 |
| Example 7 | 15 | 2 | 2 | 1 | 0.5 | 0.01 | 0.2 | Citric acid 2.0 |
| Comp. Ex. 1 | 16 | 0 | 2 | 1 | 0 | 0.01 | 0.2 | — |
| Comp. Ex. 2 | 15 | 0.4 | 2 | 1 | 0 | 0.01 | 0.2 | Starch phosphate 1.0 |
| Comp. Ex. 3 | 15 | 5 | 2 | 1 | 0 | 0.01 | 0.2 | Starch phosphate 1.0 |
| Comp. Ex. 4 | 15 | 2 | 2 | 0 | 0 | 0.01 | 0.2 | — |
| Comp. Ex. 5 | 15 | 2 | 2 | 1 | 0 | 0.01 | 0.2 | — |

Abbreviation and Other Notes for Table 1 et seq.
"Comp. Ex." means "Comparison Example".
Hydroxylamine was supplied to the bath by addition of hydroxylamine sulfate, i.e., $(NH_2OH)_2.H_2SO_4$.
Fluorine was supplied to the bath by addition of hydrofluoric acid, i.e., HF.

(2) Water rinse (tap water).

The conditions were as follows: ambient temperature (i.e. from 18 to 25° C.), 30 seconds, spray.

(3) Zinc phosphate conversion treatment.

Treatment compositions were those reported in Table 1. The process conditions were as follows: 43° C., 120 seconds, dipping.

(4) Water rinse (tap water).

The process conditions were as follows: ambient temperature, 30 seconds, spray.

(5) Rinse with deionized water with a specific electrical conductivity of not more than 0.2 microSiemens per centimeter. The process conditions were as follows: ambient temperature, 20 seconds, spray.

(6) Draining and drying.

The process conditions were as follows: 110° C. air, 180 seconds.

Painting (1) Electropainting was carried out using GT-10B™ cationic electropaint from Kansai Paint Kabushiki Kaisha. The conditions were as follows:

bath temperature: 28° C.

voltage: 200 volts current application time: 180 seconds coating thickness: 20 μm bake: 170° C., 20 minutes residence (2) An intermediate coating was applied using TP-65 8160™ melamine-alkyd paint from Kansai Paint Kabushiki Kaisha. The conditions were as follows:

coating thickness: 40 μm bake: 140° C., 20 minutes residence (3) A top coating was applied using NEO6000 D40™ melamine-alkyd paint from Kansai Paint Kabushiki Kaisha. The conditions were as follows:

coating thickness: 40 μm bake: 140° C., 20 minutes residence

Methods for evaluating the conversion coatings (1) Appearance of the coating.

The appearance was visually evaluated.

(2) Coating weight.

This was calculated from the weight difference before and after stripping with an aqueous solution containing 50 g/L of $CrO_3$.

(3) Size of the coating crystals and coating morphology.

The coating morphology was inspected and the crystal size was measured (unit: μm) using a scanning electron microscope from Nippon Denshi Kabushiki Kaisha.

(4) The P/(P+H) ratio.

The diffraction intensities from the (100) surface of phosphophyllite and the (020) surface of hopeite were measured using a Geiger Flex 2028 X-ray diffraction instrument from Rigaku Denki Kabushiki Kaisha.

Methods for evaluating the painted panels (1) Paint adherence testing (Secondary, water-resistance, adhesion testing)

The test panel, after processing up to and including electropainting, was dipped in deionized water at 40° C. for 240 hours. The test panel was then withdrawn from the water and a 100 unit checkerboard pattern was scribed on the panel with a sharp cutter down to the steel basis metal: 11 parallel lines were first scribed on a 1 -mm interval and another 11 parallel lines also on a 1 -mm interval were then scribed perpendicular to the first set. The pattern was peeled with cellophane tape and the number of squares that were at least 50% peeled was counted.

(2) Saltwater spray testing

Using a sharp cutter a cross was scribed down to the steel basis metal in the test panel after it had been processed up to and including electropainting. The test panel was then subjected to 5% saltwater spray testing (according to Japanese Industrial Standard Z-2371) for 1,000 hours. The reported value is the width in mm of the blistering in the paint film produced along the scratch, taking both sides into account.

(3) Outdoor exposure with saltwater supplement

Using a sharp cutter, a cross was scribed down to the steel basis metal in the test panel after it had been processed up to and including top coating. The panel was then exposed outdoors for 3 months in Hiratsuka, Kanagawa Prefecture, Japan. The panel was sprinkled with 5% saltwater once a week during the exposure period. The reported value is the width in mm of the blistering in the paint film produced along the scratch, taking both sides into account.

Results from the evaluations of the conversion-treated panels

Table 2 reports the results from the evaluations of the conversion-treated panels and the painted panels.

TABLE 2

| Test Result for: | Conversion Appearance | Coating Morphology | Coating Weight, $g/m^2$ | Crystal Size, μm | P/(P + H) Ratio | Paint-Loss, % of Squares | Salt-water Spray, mm | Outdoor Exposure with Salt Water, mm |
|---|---|---|---|---|---|---|---|---|
| Example 1 | Excellent | Nodular | 2.6 | 2–3 | 0.95 | 0 | 1.5 | 0.4 |
| Example 2 | Excellent | Nodular | 2.4 | 2–3 | 0.94 | 0 | 1.4 | 0.3 |
| Example 3 | Excellent | Nodular | 2.4 | 2–3 | 0.95 | 0 | 1.3 | 0.3 |
| Example 4 | Excellent | Nodular | 2.5 | 2–3 | 0.95 | 0 | 1.3 | 0.3 |
| Example 5 | Excellent | Nodular | 2.5 | 2–3 | 0.94 | 0 | 1.3 | 0.4 |
| Example 6 | Excellent | Nodular | 2.5 | 2–3 | 0.96 | 0 | 1.4 | 0.3 |
| Example 7 | Excellent | Nodular | 2.5 | 2–3 | 0.94 | 0 | 1.3 | 0.3 |
| Comp. Ex. 1 | No Coating | No Crystals | — | — | — | 75 | 2.9 | 2.5 |
| Comp. Ex. 2 | No Coating | No Crystals | — | — | — | 70 | 3.6 | 2.3 |
| Comp. Ex. 3 | Blue Color | No Crystals | — | — | — | 30 | 3 | 2.4 |
| Comp. Ex. 4 | Excellent | Nodular | 2.9 | 3–4 | 0.95 | 0 | 2 | 0.6 |
| Comp. Ex. 5 | Excellent | Nodular | 2.9 | 3–4 | 0.95 | 0 | 1.8 | 0.5 |

The results in Table 2 show that the present invention provided good results for the conversion coating on all criteria: conversion appearance, coating weight, size of coating crystals, morphology of the coating crystals, and P/(P+H) ratio. The results in Table 2 also confirm that the present invention provided an excellent paintability even in the absence of a surface conditioning step.

The remaining following tests were carried out in order to demonstrate the advantageous effects of the present invention in its second preferred embodiment as described above. Except for the phosphate conversion coating compositions used, these tests were performed in the same manner as those described above and on the same type of substrates. The conversion coating treatment solutions used are described in Table 3 and the test results are described in Table 4.

TABLE 3

| Composition for: | Concentration in g/L in the Composition of: $PO_4^{-3}$ Ions | Hydroxylamine | $Zn^{+2}$ Ions | $Ni^{+2}$ Ions | $Mn^{+2}$ Ions | $Fe^{+2}$ Ions | Fluorine | (Zinc Ions):(Phosphate Ions) Ratio by Weight |
|---|---|---|---|---|---|---|---|---|
| Example 8 | 17 | 1.2 | 4 | 0 | 0 | 0 | 0 | 0.24 |
| Example 9 | 17 | 1.2 | 4 | 0 | 0 | 0.01 | 0.2 | 0.24 |
| Example 10 | 20 | 1.2 | 5 | 1 | 0 | 0.01 | 0.2 | 0.25 |
| Example 11 | 25 | 2.8 | 5 | 1 | 0 | 0.01 | 0.2 | 0.2 |
| Example 12 | 15 | 1.2 | 2 | 1 | 0 | 0.01 | 0.2 | 0.13 |
| Example 13 | 30 | 1.2 | 7 | 1 | 0 | 0.01 | 0.2 | 0.23 |
| Example 14 | 20 | 1.2 | 5 | 1 | 0.5 | 0.01 | 0.2 | 0.25 |
| Comp. Ex. 6 | 17 | 0.4 | 4 | 0 | 0 | 0.01 | 0.2 | 0.24 |
| Comp. Ex. 7 | 35 | 4.8 | 8 | 1 | 0 | 0.01 | 0.2 | 0.23 |
| Comp. Ex. 8 | 15 | 1.2 | 1 | 1 | 0 | 0.01 | 0.2 | 0.07 |
| Comp. Ex. 9 | 40 | 1.2 | 11 | 1 | 0 | 0.01 | 0.2 | 0.28 |
| Comp. Ex. 10 | 15 | 4.8 | 3 | 1 | 0 | 0.01 | 0.2 | 0.2 |

TABLE 4

| Test Result for: | Conversion Appearance | Coating Morphology | Coating Weight, $g/m^2$ | Crystal Size, $\mu m$ | P/(P + H) Ratio | Paint-Loss, % of Squares | Salt-water Spray, mm | Outdoor Exposure with Salt Water, mm |
|---|---|---|---|---|---|---|---|---|
| Example 8 | Excellent | Nodular | 3 | 4–5 | 0.95 | 0 | 2 | 0.5 |
| Example 9 | Excellent | Nodular | 2.9 | 3–4 | 0.94 | 0 | 1.8 | 0.4 |
| Example 10 | Excellent | Nodular | 2.9 | 3–4 | 0.96 | 0 | 1.5 | 0.4 |
| Example 11 | Excellent | Nodular | 3 | 4–5 | 0.94 | 0 | 2.1 | 0.4 |
| Example 12 | Excellent | Nodular | 3 | 3–4 | 0.97 | 0 | 1.8 | 0.5 |
| Example 13 | Excellent | Nodular | 3 | 3–4 | 0.94 | 0 | 1.9 | 0.4 |
| Example 14 | Excellent | Nodular | 2.8 | 3–4 | 0.95 | 0 | 1.8 | 0.3 |
| Comp. Ex. 6 | No Coating | No Crystals | — | — | — | 70 | 4.5 | 2.5 |
| Comp. Ex. 7 | Excellent | Nodular to Leaflet | 12 | 10–11 | 0.94 | 10 | 2.5 | 0.7 |
| Comp. Ex. 8 | Incomplete Coating | Nodular | 1.4 | 5–6 | 0.95 | 5 | 3 | 0.6 |
| Comp. Ex. 9 | Excellent | Nodular to Leaflet | 10.7 | 9–10 | 0.93 | 40 | 3.9 | 0.8 |
| Comp. Ex. 10 | Blue Color | No Crystals | — | — | — | 36 | 4.3 | 2.2 |

Benefits of the Invention

The results reported in Tables 1 to 4 confirm that the present invention provides high-quality conversion coatings even in the absence of a surface conditioning treatment.

The invention claimed is:

1. A liquid composition suitable for forming a zinc phosphate conversion coating on a metal surface by contact and reaction therewith, said liquid composition comprising water and the following dissolved components:

(A) a concentration of 5 to 50 g/L of phosphate ions;

(B) a concentration of 0.2 to 10 g/L of zinc ions;

(C) a hydroxylamine source in a quantity that provides a concentration of 0.5 to 4.0 g/L stoichiometric equivalent as hydroxylamine; and (D) at least one of components (D.1) and (D.2) as follows:

(D.1) a concentration of 0.01 to 5.0 g/L in total of at least one substance selected from the group consisting of polycarboxylic acids, salts thereof, and starch phosphate;

(D.2) a concentration of zinc ions that is at least 2.0 g/L and has a ratio to the concentration of phosphate ions in the same liquid composition that is not greater than 0.27:1.0.

2. A liquid composition according to claim 1, wherein component (D.1) is present and includes at least one substance selected from the group consisting of citric acid, succinic acid, tartaric acid, and salts of citric, succinic, and tartaric acids.

3. A liquid composition according to claim 1, wherein component (D.2) is present.

4. A liquid composition according to claim 3, additionally comprising at least one substance selected from the group consisting of ferrous ions, nickel ions, manganese ions, nitrate ions, fluorine in the form of a soluble compound of fluorine, and complex fluoride ions.

5. A liquid composition according to claim 2, additionally comprising at least one substance selected from the group consisting of ferrous ions, nickel ions, manganese ions, nitrate ions, fluorine in the form of a soluble compound of fluorine, and complex fluoride ions.

6. A liquid composition according to claim 1, additionally comprising at least one substance selected from the group consisting of ferrous ions, nickel ions, manganese ions, nitrate ions, fluorine in the form of a soluble compound of fluorine, and complex fluoride ions.

7. A process for forming a zinc phosphate conversion coating layer on a surface of a metal substrate that has not been subjected to surface conditioning with a colloidal titanium-containing treatment bath, said process comprising an operation of contacting the surface of the metal substrate with an aqueous phosphating solution according to claim 6.

8. A process according to claim 7, wherein the aqueous phosphating solution is maintained at a temperature in a range from 40 to 50° C. during a contacting time of at least 1.0 minute.

9. A process according to claim 8, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

10. A process according to claim 7, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

11. A process for forming a zinc phosphate conversion coating layer on a surface of a metal substrate that has not been subjected to surface conditioning with a colloidal titanium-containing treatment bath, said process comprising an operation of contacting the surface of the metal substrate with an aqueous phosphating solution according to claim 4.

12. A process according to claim 11, wherein the aqueous phosphating solution is maintained at a temperature in a range from 40 to 50° C. during a contacting time of at least 1.0 minute.

13. A process according to claim 12, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

14. A process according to claim 11, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

15. A process for forming a zinc phosphate conversion coating layer on a surface of a metal substrate that has not been subjected to surface conditioning with a colloidal titanium-containing treatment bath, said process comprising an operation of contacting the surface of the metal substrate with an aqueous phosphating solution according to claim 2.

16. A process according to claim 15, wherein the aqueous phosphating solution is maintained at a temperature in a range from 40 to 50° C. during a contacting time of at least 1.0 minute.

17. A process according to claim 16, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

18. A process for forming a zinc phosphate conversion coating layer on a surface of a metal substrate that has not been subjected to surface conditioning with a colloidal titanium-containing treatment bath, said process comprising an operation of contacting the surface of the metal substrate with an aqueous phosphating solution according to claim 1.

19. A process according to claim 18, wherein the aqueous phosphating solution is maintained at a temperature in a range from 40 to 50° C. during a contacting time of at least 1.0 minute.

20. A process according to claim 19, wherein the aqueous phosphating solution is replenished during its use by addition of a volume of a replenisher composition that is an aqueous solution containing zinc ions, phosphate ions, and hydroxylamine source in a total concentration of these species that is at least 15 weight %.

21. A liquid composition according to claim 1, wherein the source of hydroxylamine is hydroxylamine sulfate.

22. A process according to claim 18, wherein the source of hydroxylamine is hydroxylamine sulfate.

* * * * *